US010106374B2

(12) United States Patent
Cortona et al.

(10) Patent No.: US 10,106,374 B2
(45) Date of Patent: Oct. 23, 2018

(54) METHOD FOR OPERATING AN ELEVATOR SYSTEM AND AN ELEVATOR CONTROL DEVICE OPERATING IN ACCORDANCE WITH THE METHOD

(71) Applicant: INVENTIO AG, Hergiswil (CH)

(72) Inventors: Elena Cortona, Zurich (CH); Frankie Schmid, Ebikon (CH)

(73) Assignee: INVENTIO AG, Hergiswil (CH)

( * ) Notice: Subject to any disclaimer, the term of this patent is extended or adjusted under 35 U.S.C. 154(b) by 0 days.

(21) Appl. No.: 15/302,534

(22) PCT Filed: Apr. 13, 2015

(86) PCT No.: PCT/EP2015/057980
§ 371 (c)(1),
(2) Date: Oct. 7, 2016

(87) PCT Pub. No.: WO2015/158662
PCT Pub. Date: Oct. 22, 2015

(65) Prior Publication Data

US 2017/0022028 A1 Jan. 26, 2017

(30) Foreign Application Priority Data

Apr. 14, 2014 (EP) ..... 14164640

(51) Int. Cl.

| | |
|---|---|
| ***G08B 21/00*** | (2006.01) |
| ***B66B 5/00*** | (2006.01) |
| ***B66B 3/00*** | (2006.01) |
| ***B66B 7/12*** | (2006.01) |
| *B66B 9/00* | (2006.01) |

(52) U.S. Cl.
CPC ..... *B66B 5/0025* (2013.01); *B66B 3/002* (2013.01); *B66B 5/0006* (2013.01); *B66B 7/1215* (2013.01); *B66B 9/00* (2013.01)

(58) Field of Classification Search
CPC ..... B66B 5/0025; B66B 3/002; B66B 5/006; B66B 7/1215; B66B 9/00
USPC ..... 187/390
See application file for complete search history.

(56) References Cited

U.S. PATENT DOCUMENTS

| | | | | |
|---|---|---|---|---|
| 4,771,865 A * | 9/1988 | Hinderling | B66B 5/0006 | 187/391 |
| 5,644,111 A | 7/1997 | Cerny et al. | | |
| 6,603,398 B2 * | 8/2003 | Tinone | B66B 13/22 | 187/316 |

(Continued)

FOREIGN PATENT DOCUMENTS

| | | |
|---|---|---|
| CN | 101269769 A | 9/2008 |
| CN | 203143851 U | 8/2013 |

(Continued)

*Primary Examiner* — Jeffrey Donels
(74) *Attorney, Agent, or Firm* — William J. Clemens; Shumaker, Loop & Kendrick, LLP

(57) ABSTRACT

A method for operating an elevator installation uses an elevator control device, wherein, by at least one sensor allocated to the elevator installation and by a sensor signal obtainable therefrom, a state of the elevator installation is automatically detected by the elevator control device. In dependence on the detected state, the elevator control device automatically generates an activation signal to automatically activate a remote signaling element.

15 Claims, 3 Drawing Sheets

(56) References Cited

U.S. PATENT DOCUMENTS

| | | | | |
|---|---|---|---|---|
| 6,630,886 | B2 * | 10/2003 | Malone, Jr. | B66B 5/005 187/390 |
| 2007/0131485 | A1 | 6/2007 | Kuo et al. | |
| 2008/0283342 | A1 | 11/2008 | Deplazes et al. | |
| 2013/0146399 | A1 * | 6/2013 | De Coi | B66B 5/0031 187/393 |
| 2017/0197805 | A1 * | 7/2017 | Keiser | B66B 5/0087 |

FOREIGN PATENT DOCUMENTS

| | | | |
|---|---|---|---|
| CN | 103588059 | A | 2/2014 |
| GB | 2145859 | A | 4/1985 |
| JP | 2001080833 | A | 3/2001 |
| JP | 2002167134 | A | 6/2002 |
| JP | 2012051665 | A | 3/2012 |
| WO | 2014048826 | A1 | 4/2014 |

* cited by examiner

METHOD FOR OPERATING AN ELEVATOR SYSTEM AND AN ELEVATOR CONTROL DEVICE OPERATING IN ACCORDANCE WITH THE METHOD

FIELD

First and foremost, the invention relates to a method for operating an elevator system, namely a method for monitoring an elevator system during operation. Furthermore, the invention also relates to an elevator control device operating in accordance with the method. Finally, the invention also relates to a computer program for implementing the method and a computer program product having such a computer program and a device, namely the elevator control device for example, having such a computer program as means for executing the method.

BACKGROUND

The operation of an elevator system by means of an elevator control device is known per se in terms of its essential features and therefore does not need to be explained here.

One object of the present invention consists in specifying a further option for monitoring an elevator system during operation.

SUMMARY

This object is achieved with a method for operating an elevator system. In the method according to the invention, it is provided that a state of the elevator system is detected automatically by means of at least one sensor included in the elevator system or assigned to the elevator system and a sensor signal that can be received therefrom, that a possible exceptional situation or an imminent exceptional situation of the elevator system is automatically determined as a function of the respectively detected state and an activation signal is generated and that at least one remote signalling element is activated automatically by means of the activation signal.

In the present context, the term "remote signalling element" is understood to mean any signalling element which is suitable to attract the attention of people at a relatively large distance. In this case, a relatively large distance is understood to mean a distance of more than 10 meters, preferably a distance of more than 50 meters, and particularly preferably a distance of more than 100 meters.

At least one warning lamp, for example a warning lamp in the form of a rotating lamp or a rotary mirror lamp preferably functions as a remote signalling element. One such warning lamp is for example attached on a switch cabinet or the like, in which the elevator control device or parts of the elevator control device is/are located. The warning lamp is preferably attached at a central point, for example centrally at the top on the switch cabinet. The term warning lamp and the possible embodiments as rotating lamp or rotary mirror lamp should differentiate the remote signalling element from an indicator in the form of an LED or the like, as are usually used on switch cabinets, for example on control panels formed there. A warning lamp has the advantage that the activation thereof can be recognized immediately and over a wide area and that activation of a warning lamp is also readily understood as an indication of an exceptional situation by personnel with little training. This is true for a caretaker for example, who, during a regular inspection of the machine room of an elevator system, will recognize the activation of a warning lamp located there and will understand this as an indication of an exceptional situation. Thus, the caretaker can inform the operating company for the elevator system and/or service personnel. As the activation of a warning lamp can therefore also be recognized as an indication of an exceptional situation by people who are not entrusted with the installation or maintenance of an elevator system, it is also possible to install a warning lamp of this type in an office which is used by personnel entrusted with building management, that is to say for example in an office of the caretaker. Additionally or alternatively, it is also possible to attach a warning lamp, which can be controlled by means of the activation signal, at a location where it is possible to assume that a possible activation of the warning lamp will be noticed early on, for example a floor, particularly a floor which is heavily frequented.

In this case, an exceptional situation is understood to mean any deviation from an optimum or normal operating situation. Thus, an exceptional situation is not necessarily a fault in the elevator system or even a dangerous situation, but rather an evaluation of a state of the elevator system as an exceptional situation even begins in the case of changes to the state of the elevator system that relate to normal wear or something similar. A lengthening of a compensating cable, monitored by means of a sensor and a sensor signal output thereby, may be mentioned as an example in this regard.

The advantage of the invention consists in the fact that an exceptional situation or an imminent exceptional situation is recognized in good time, so that there is the option to react to the exceptional situation in a suitable manner, for example in that spare parts or the like are procured in good time and/or personnel for carrying out maintenance and/or repair operations is summoned to the location of the elevator system in good time.

It is optionally provided in an embodiment of the method that an activated remote signalling element can only be deactivated by means of a control action usually designated as acknowledgement, namely acknowledgement of the signalled exceptional situation, and that such a control action, which deactivates the remote signalling element, is logged automatically. In this manner, it is possible at a later point in time to trace when an acknowledgement of the signalled exceptional situation has taken place and who performed it.

In a further embodiment of the method, the detection of the state of the elevator system and an underlying evaluation of a sensor signal or a plurality of sensor signals take place by means of an evaluating logic of an elevator control device intended to control the elevator system. A plurality of sensor signals are linked logically and temporally by means of the evaluating logic. Thus, the evaluating logic allows individual sensor signals to be combined as necessary, so that a sensible, automatic evaluation of the sensor signals is possible with regards to a state to be monitored/an exceptional situation of the elevator system to be detected, in accordance with the respective implementation of the evaluating logic. The evaluating logic can furthermore easily be adapted to changed requirements.

In a particular embodiment of the monitoring of the elevator system suggested here, the evaluating logic comprises a prediction logic for predicting an expected future state of the elevator system, wherein a logical and/or temporal linkage of a plurality of sensor signals and/or temporal changes of such sensor signals takes place by means of the prediction logic. An example for such a prediction of a future state of the elevator system can be formed from the example of a sensor assigned to a compensating cable and a sensor signal that can be received therefrom. If a first time derivative of the sensor signal encoding a change in length of the compensating cable is formed, this is a measure for how quickly the compensating cable is lengthening and therefore makes it possible to predict when, with respect to the compensating cable, a requirement for on-site inspection by service personnel or, if appropriate, a requirement to replace the compensating cable will occur.

A remote signalling element generated on the basis of an automatically generated activation signal may be fundamentally overlooked or not heard, for example if no service personnel are on site. In a particular embodiment of the method, which is not necessarily based on a signalling element in the form of a warning lamp, it is correspondingly provided that, in the event of generation of the activation signal—that is to say if an exceptional situation has been detected automatically—an alarm signal is generated automatically in accordance with a forwarding logic, which is realized as a functionality of the elevator control device. One such alarm signal is sent to a mobile telephone of a service technician for example, so that it is ensured that the automatically detected exceptional situation can be noticed.

In a further or alternative embodiment of the invention, which is likewise not necessarily based on a remote signalling element in the form of a warning lamp, it is provided that in the event of the activation signal being generated, a requirement signal is generated automatically, wherein a requirement signal of this type is sent to an external server for example and is evaluated as an order for spare parts there. The respectively automatically detected exceptional situation is always linked with at least one underlying sensor signal and therefore with the or each sensor delivering the respective sensor signal and therefore ultimately also with at least one monitored component in each case or a monitored component or functional unit of the elevator system. On this basis, it is possible to ensure by means of an automatically generated requirement signal that a spare part, which can be identified on the basis of the underlying sensor signal/sensor, is ordered in good enough time, so that it is available when required.

The above-mentioned object is also achieved with an elevator control device, which is intended and set up for executing the method. In this case, the invention is preferably implemented in software. The invention is therefore also a computer program with program code instructions that can be executed by a computer on the one hand and a storage medium with such a computer program, that is to say a computer program product with program code means, and finally also an elevator control device, in the memory of which a computer program of this type is or can be loaded as means for carrying out the method and the embodiments thereof.

An exemplary embodiment of the invention is described in more detail below on the basis of the drawings. Subjects or elements which correspond to one another are provided with the same reference numbers in all figures.

The or each exemplary embodiment is not to be understood as a limitation of the invention. Rather, in the context of the present disclosure, amendments and modifications are absolutely possible, particularly those which can be inferred for the person skilled in the art, with regard to the achievement of the object, for example by combination or amendment of individual features or method steps which are described in connection with the general or specific part of the description and also contained in the claims and/or the drawing and lead to a new subject or to new method steps or method step sequences by means of combinable features.

DETAILED DESCRIPTION

Figure 1:
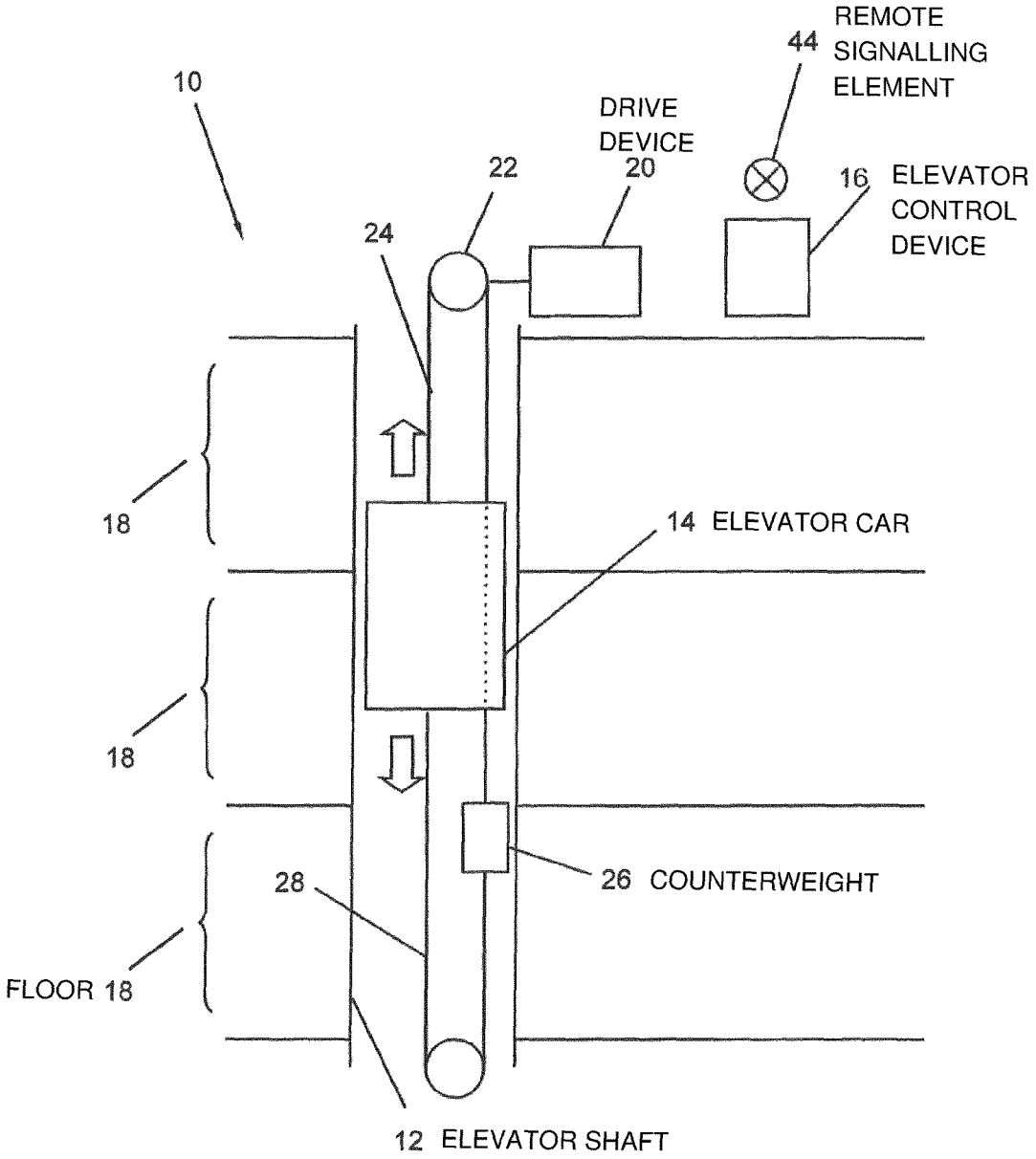
FIG. 1 shows an elevator system having an elevator control device.

The illustration in FIG. 1 shows, schematically and in a very simplified manner, an elevator system 10 in a building, which is not shown itself, with at least one elevator car 14, which can be moved in at least one elevator shaft 12, and an elevator control device 16 provided at a central location in the building. The elevator control device 16 is provided in a manner known per se for controlling the elevator system 10. The or each elevator car 14 can be moved in a manner known per se in the elevator shaft 12 or in the respective elevator shaft 12, so that different floors 18 of the building can be reached.

A drive device 20, for example in the form of an electric motor, is provided in a manner known per se for moving the elevator car 14. For this purpose, the drive device 20 drives a drive pulley 22 or the like, likewise in a form known per se, so that the respective movement of the elevator car 14, usually a vertical movement, and a movement of a counterweight 26 takes place by means of one or more carrier cables 24—termed suspension ropes in technical terminology—guided over the drive pulley 22. A compensating cable 28—termed a compensation rope in technical terminology—is suspended on the underside of the elevator car 14 and the underside of the counterweight 26, in order to compensate the weight of the or each carrier cable 24.

Sensors 30 (FIG. 2) can be connected to the elevator system 10 or individual components of the elevator system 10 at individual points or simultaneously at various points, which sensors allow an automatic evaluation of a state of the elevator system 10.

Thus, a sensor 30 can be provided for detecting a lengthening of the carrier cable 24 or for detecting a lengthening of the compensating cable 28 for example. If there is a multiplicity of carrier and/or compensation cables 24, 28, one sensor 30 can be assigned to one of the cables 24, 28 or a plurality of cables 24, 28 for detecting lengthening or a plurality of sensors 30 can be assigned to one cable 24, 28 in each case. A different example for a sensor 30 for detecting a state of the elevator system 10 is a sensor which detects the power consumption of the drive device 20 or another drive device, for example a drive device for driving the car or floor doors. A further example is a sensor 30, which detects vibrations of the or a carrier cable 24 or vibrations of the or a compensating cable 28. A still further example for a sensor is a sensor system 30, by means of which operation of electrical units, such as for example operation of the drive device 20, is monitored on an acoustic basis. Basically, any type of sensor may be considered as a sensor 30, so the previously mentioned examples are explicitly only to be understood in an explanatory manner and not in a limiting manner.

A measured value that can be obtained from such a sensor 30 during operation is monitored continuously or regularly, for example at equidistant time intervals, for example with respect to at least one predetermined or predeterminable threshold value. One such monitoring takes place by means of the elevator control device 16 and is implemented as part of the functionality of the elevator control device 16, for example in software.

Figure 2:
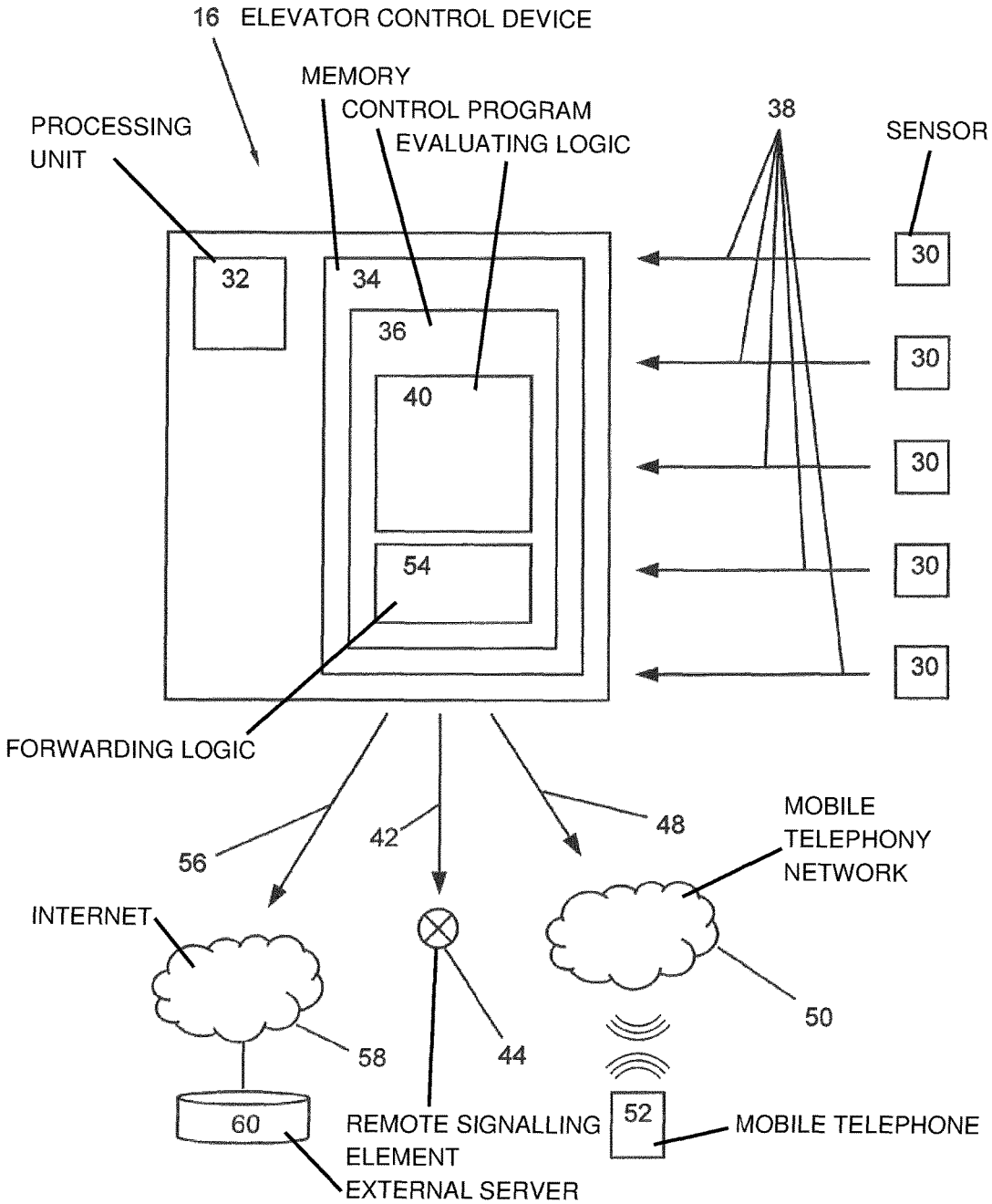
FIG. 2 shows the elevator control device with further details.

The illustration in FIG. 2 shows that the elevator control device 16 therefore comprises a processing unit 32 in the form of a microprocessor 32 or of microprocessor type and a memory 34 in a manner known per se, in which a control program 36 (computer program) is loaded, which is executed during operation of the elevator control device 16 by means of the respective processing unit 32.

The monitoring of the or each sensor 30 for detecting a state of the elevator system 10 takes place as part of the functionality of the elevator control device 16 implemented in the context of the control program 36. The illustration in FIG. 2 therefore only symbolically shows individual sensors 30 and sensor signals 38 that can be received therefrom in each case. Each sensor 30 is assigned to the elevator system 10 or a component of the elevator system, for example a compensating cable 28 for detecting a lengthening of the compensating cable 28, in a respectively suitable manner.

The sensor signals 38 are transmitted to the elevator control device 16 in a manner known per se in a wired or wireless manner and automatically evaluated there in accordance with the control program 36. The elevator control device 16 in this case generates an activation signal 42 if necessary. This takes place by means of an evaluating logic 40 provided for evaluating the sensor signals 38, which is implemented as part of the functionality of the control program. An automatic activation of a remote signalling element 44, particularly a remote signalling element 44 spatially assigned to the elevator control device 16, takes place by means of the activation signal 42. This is a remote signalling element 44 in the form of a warning lamp 44 or a horn or the like, for example. A machine room of the elevator system 10 is possible as a location for attaching such a remote signalling element 44 for example, that is to say a room in which the elevator control device 16 and/or the drive device 20 are located for example. The remote signalling element 44 can be arranged in any other room, for example in the room of the porter, the caretaker or a maintenance department, or even outdoors.

The respective monitoring of a sensor signal 38 or a plurality of sensor signals 38 depends on the type of the respective sensor 30. In the case of a sensor 30, which delivers an analog sensor signal 38, the sensor signal 38 is usually monitored with respect to the reaching or exceedance or failure to reach a predetermined or predeterminable threshold value. In the case of a sensor 30, which delivers a digital sensor signal 38, the arrival of such a sensor signal 38 is monitored. In the case of a sensor 30 with its own processing logic, which delivers a digitally encoded status word as sensor signal 38 for example, the status word or individual status bits in the status word are monitored.

In the interests of better readability of the following description, this is explained—but without forgoing additional general validity—by way of the example of an analog sensor signal 38 representing a measured value and the monitoring thereof on the basis of a predetermined or predeterminable threshold value. Then, reaching or exceeding or failing to reach a threshold value of this type—continued in the following by way of the example of exceeding, without forgoing additional general validity—means an exceptional situation in the elevator system 10 and an exceptional situation of this type has automatically been determined with the detection of the exceeding of the threshold value. The analog value received as sensor signal 38 is compared with the respective threshold value by means of the evaluating logic 40. In the case of a more complex monitoring, it can also be provided that an exceptional situation only counts as determined if a sensor signal 38 which can be received from a first sensor 30 exceeds the threshold value assigned to this first sensor 30 and at least one sensor signal 38 which can be received from a second sensor 30 exceeds the threshold value assigned to this second sensor 30 simultaneously or within a predetermined or predeterminable time interval. A comparison of this type of two analog values received as sensor signal 38 and the logical and temporal linking thereof likewise takes place by means of the evaluating logic 40. Basically, no limits are placed on the possibilities for a logical and/or temporal combination of detected threshold value exceedances, that is to say no limits are placed on the actual implementation of the functionality of the evaluating logic 40, and the above-outlined simple example of an AND linkage of two threshold value exceedances is explicitly only to be understood as an explanatory example. Furthermore, it can also be provided that it is not or not only a respective sensor signal 38 itself, but rather for example a temporal change of a sensor signal 38 that is observed and the reaching or exceedance or failure to reach a predetermined or predeterminable threshold value is monitored.

In a particular embodiment, the evaluating logic 40 is realized as a prediction logic or the evaluating logic 40 comprises a functionality functioning as prediction logic. A prediction with respect to a future state of the elevator system 10 to be expected on the basis of one or more sensor signals 38 is possible automatically by means of the prediction logic. A logical combination of monitoring of a plurality of sensor signals 38 and/or a logical combination of monitoring of temporal changes of such sensor signals 38 is implemented by means of the prediction logic for example.

If an exceptional situation has been detected by means of the elevator control device 16 and the evaluating logic 40, the activation signal 42 is generated and the remote signalling element 44, for example a signalling element for optically displaying the exceptional situation or a signalling element for acoustically indicating the exceptional situation, that is to say a warning lamp 44 or a horn or the like, is therefore likewise automatically activated by means of the elevator control device 16. Additionally or alternatively, a display element 46 in the form of a screen 46 or printer is also considered as a further signalling element 46, on which the respective exceptional situation is illustrated or output in a manner that can be read by the operating personnel and/or can be recognized on the basis of a clear iconography in another form.

Figure 3:
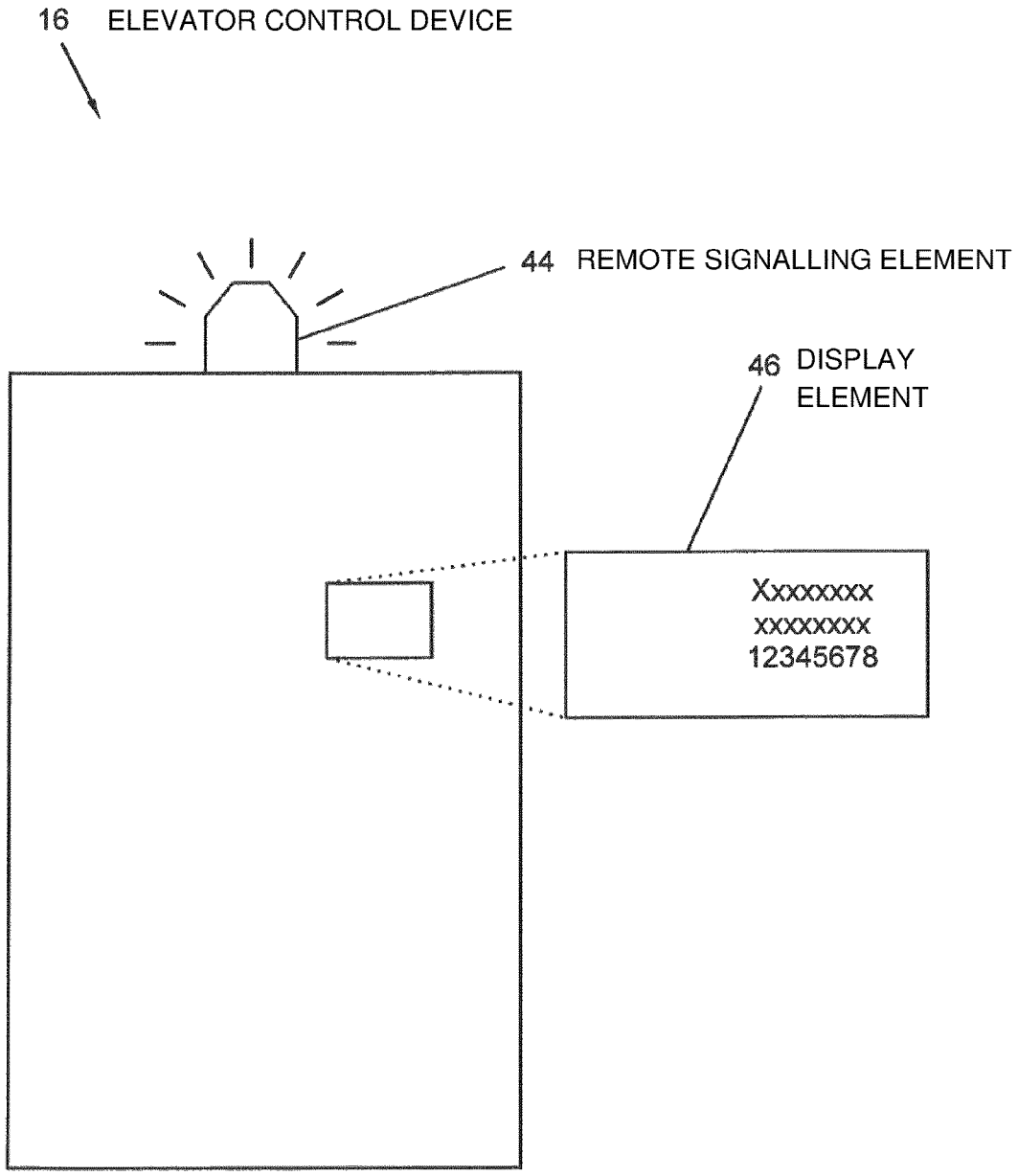
FIG. 3 shows a possible mounting situation of a warning lamp that can be activated automatically in the context of the approach suggested here.

The illustration in FIG. 3 shows a warning lamp 44 in the form of a rotating lamp or a rotary mirror lamp as remote signalling element 44 and a display element 46 in the form of a monitor/LCD monitor 46 as a further signalling element 46. In the example illustrated, the warning lamp 44 is attached on a switch cabinet in which the elevator control device 16 is located. Service personnel approaching the elevator control device 16, for example because the machine room, in which the elevator control device 16 is located, is entered, immediately recognize the presence of an exceptional situation in the event of activation of the warning lamp 44. Additional information about the respective exceptional situation can be obtained by means of an alphanumeric and/or numeric and/or iconographic display of the LCD monitor 46, which is only indicated symbolically here.

In the event of activation of the remote signalling element 44, this is a sign for operating personnel of the elevator system 10 that there is currently or will in the future be a repair and/or maintenance requirement with respect to the elevator system 10. In the case of a sensor 30 assigned to a compensating cable 28 and a sensor signal 38, which can be received therefrom, as a measure for a determined change in length, threshold-value exceedance of such a sensor signal 38 for example indicates that it may become necessary or will become necessary to replace a compensating cable 28 in the foreseeable future.

Signalling of a detected exceptional situation is therefore a pre-alarm to a certain extent, before the requirement for repairs and/or maintenance measures has actually started. On the basis of such a pre-alarm, the operating personnel can introduce corresponding measures in good time, for example order spare parts, so that a case of repair is prevented and/or in the event of a necessary intervention in the elevator system 10 in the form of maintenance and/or repair operations, the duration of the shutdown of the elevator system 10 necessary therefor is limited to a minimum, because for example, all required spare parts are already on site and available. Furthermore, it is also possible on the basis of such a pre-alarm, to plan repairs and/or maintenance measures in such a manner that, where possible, these operations are carried out at times, in which the elevator system 10 is not used or is used little.

In addition to signalling a pre-alarm of this type in the spatial vicinity of the elevator control device 16 by means of a warning lamp 44 or the like or alternatively to such signalling, it is also possible that the pre-alarm is transmitted in the form of an electronic message to a mobile telephone 52 or the like of a service technician. In the following, this is termed an external signalling of the pre-alarm. In this case, the elevator control device 16 generates an alarm signal 48 in accordance with the control program 36, which alarm signal is transmitted—usually in a wireless manner, for example via a mobile telephony network 50—to the respective device of the service technician, that is to say for example a mobile telephone 52.

In the case of such external signalling, forwarding of the pre-alarm to a mobile telephone 52 or the like can take place depending on different criteria in accordance with a predetermined or predeterminable forwarding logic 54, which is realized as part of the functionality of the control program 36 for example. Examples in this regard are a duration of the pending state of the pre-alarm without acknowledgement by operating personnel at the site of the elevator control device 16 or a type of pre-alarm and/or a type of the exceptional situation on which the pre-alarm is based.

To monitor a duration of the pending state of the pre-alarm, a counter of the forwarding logic 54 or another form of timer is for example started automatically by the elevator control device 16 when an exceptional situation is detected. If operating personnel are located at the site of the elevator control device 16 and take note of the exceptional situation due to the activation for example of the warning lamp 44, the operating personnel acknowledge or in some other way confirm the exceptional situation. This leads to the counter being stopped and reset. If, however, the counter runs out or reaches a predetermined or predeterminable limit value, it has automatically been recognized that the pre-alarm has clearly not been noticed. This may be a criterion for external signalling of the pre-alarm. Then, the alarm signal 48 is generated automatically when the counter runs out and causes an electronic message to be sent to a mobile telephone 52 or the like of a service technician as alarm signal 48 for example. The electronic message comprises information about the pre-alarm and for example also information about the original trigger of the activation signal 42.

Additionally or alternatively, the type of pre-alarm can also be evaluated. Therefore, each sensor 30 monitored by the elevator control device 16 is assigned to at least one category. This category is called up and evaluated by means of the forwarding logic 54. If a threshold value is exceeded, the counter is for example automatically set to a start value, which depends on the respective category, as functionality of the forwarding logic 54. Thus, the time period covered using the counter, which lasts until an external signalling takes place on the basis of the detected exceptional situation, can be set automatically as a function of the category. A sensor 30, which monitors a particularly sensitive component of the elevator system 10, is assigned to a category, which leads to a very short waiting time or even to a zero wait time, so that the external signalling and the generation of the alarm signal 48 takes place very quickly or even immediately when the exceptional situation is detected.

Furthermore, each sensor 30 or even a value range of a sensor signal 38 can be assigned to a further category, so that in the case of a threshold value being exceeded or in the case of a sensor signal 38 in a certain value range, not only an activation signal 42 and if appropriate an alarm signal 48, but rather also or instead of such signals 42, 48, a requirement signal 56 is generated, which is sent in a wired or wireless manner, for example via the Internet 58, to an external server 60 or the like and is there evaluated as a requirement message or spare parts order as it were. The requirement signal 56 therefore comprises an identifier referencing the respective elevator system 10 in encoded form and also at least one identifier, which encodes the sensor 30, the sensor signal 38 of which forms the basis for the requirement signal 56, or equivalent data. If appropriate, an encoded form of the respective sensor signal 38 is also transmitted in the context of the requirement signal 56. In any case, the receipt of the requirement signal 56 on the side of the external server 60—usually a server of the manufacturer or the elevator system 10 or the operating company of the elevator system 10—allows automatic evaluation of the thus-received information and the triggering, on the basis thereof, of a spare parts order and/or the direct or subsequent sending of such spare parts or the like. In this context, an allocation of service personnel to the respective elevator system 10 can also take place on the part of the manufacturer or operating company.

Although the invention has been described in detail by means of the exemplary embodiment, the invention is not limited by the disclosed example(s) and other variations can be derived therefrom by the person skilled in the art, without leaving the protective scope of the invention.

Individual important aspects of the description filed here can therefore be summarized in brief as follows: A method for operating an elevator system 10 and an elevator control device 16 working in accordance with the method are specified, wherein a state of the elevator system 10 is detected automatically by means of at least one sensor 30 assigned to the elevator system 10 and a sensor signal 38 that can be received therefrom, wherein an activation signal 42 is generated automatically as a function of the respectively detected state and wherein a remote signalling element 44 is activated automatically by means of the activation signal 42.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A method for operating an elevator system comprising the steps of:

detecting automatically a state of the elevator system by at least one sensor assigned to the elevator system and generating a sensor signal representing the detected state;

generating automatically an activation signal as a function of the detected state in response to the sensor signal when the sensor signal exceeds a predetermined threshold indicative of an exceptional situation, the exceptional situation relating to future repair or maintenance of the elevator system; and activating automatically a remote signalling element in response to the activation signal.

2. The method according to claim 1 wherein the remote signalling element when activated can only be deactivated by a control action and wherein the control action, which deactivates the remote signalling element, is logged automatically.

3. The method according to claim 1 wherein at least one warning lamp in a form of a rotating lamp or a rotary mirror lamp functions as the remote signalling element.

4. The method according to claim 1 wherein the at least one sensor is assigned to a compensating cable of the elevator system and detects a lengthening of the compensating cable as the state of the elevator system.

5. The method according to claim 1 wherein the detection of the state of the elevator system and an underlying evaluation of the sensor signal is performed by an evaluating logic of an elevator control device controlling the elevator system, and wherein the sensor signal and at least another sensor signal are at least one of logically and temporally linked by the evaluating logic.

6. The method according to claim 5 wherein the evaluating logic comprises a prediction logic for predicting an expected future state of the elevator system and wherein at least one of logical linkage and temporal linkage of at least one of the sensor signals and temporal changes of the sensor signals is performed by the prediction logic.

7. The method according to claim 1 wherein in response to the generation of the activation signal, an alarm signal is generated automatically in accordance with a forwarding logic of an elevator control device controlling the elevator system.

8. The method according to claim 1 wherein in response to the activation signal being generated, a requirement signal is generated automatically.

9. A computer program product comprising a control program having program code means for performing the method according to claim 1, the control program being stored on a non-transitory, computer-readable storage medium, when the computer program is executed by a processing unit of an elevator control device for controlling the elevator system.

10. An elevator control device for controlling an elevator system comprising:

a processing unit running a control program including evaluating logic for evaluating a sensor signal received from a sensor or a plurality of sensor signals received from a plurality of sensors and automatically generating an activation signal as a function of the sensor signal or the plurality of sensor signals when the sensor signal or the plurality of sensor signals exceeds a predetermined threshold indicative of an exceptional situation, the exceptional situation relating to future repair or maintenance of the elevator system; and a remote signalling element in a form of a warning lamp activated in response to the activation signal.

11. The elevator control device according to claim 10 wherein the warning lamp is a rotating lamp or a rotary mirror lamp.

12. The elevator control device according to claim 10 wherein the remote signalling element when activated can only be deactivated by a control action that can be logged.

13. The elevator control device according to claim 10 including a memory in which the computer program is loaded for execution by the processing unit during operation of the elevator control device.

14. The method according to claim 1, wherein the at least one sensor is configured for detecting a member selected from the group consisting of: a lengthening of a carrier cable, a lengthening of a compensating cable, a lengthening of a plurality of cables, a power consumption of a drive device, vibrations of a carrier cable, and vibrations of a compensating cable.

15. A method for operating an elevator system comprising the steps of:

detecting automatically a state of the elevator system by at least one sensor assigned to the elevator system and generating a sensor signal representing the detected state, wherein the at least one sensor is assigned to a compensating cable of the elevator system and detects a lengthening of the compensating cable as the state of the elevator system;

generating automatically an activation signal as a function of the detected state in response to the sensor signal; and activating automatically a remote signalling element in response to the activation signal.

* * * * *